US006271800B1

(12) United States Patent
Nakamura et al.

(10) Patent No.: US 6,271,800 B1
(45) Date of Patent: Aug. 7, 2001

(54) CIRCULARLY POLARIZED CROSS DIPOLE ANTENNA

(76) Inventors: Takashi Nakamura, 207, Honjo Jutaku 3, 3680-15, Honjo, Gifu-shi, Gifu-ken; Koji Nishida, 103, 7 Box-es, 2-45-19, Arai, Nakano-ku, Tokyo, both of (JP)

( * ) Notice: Subject to any disclaimer, the term of this patent is extended or adjusted under 35 U.S.C. 154(b) by 0 days.

(21) Appl. No.: 09/543,253

(22) Filed: Apr. 5, 2000

(30) Foreign Application Priority Data

Oct. 14, 1999 (JP) ..... 11-292460

(51) Int. Cl.[7] ..... H01Q 21/26

(52) U.S. Cl. ..... 343/797; 343/805

(58) Field of Search ..... 343/797, 808, 343/805; H01Q 21/26

(56) References Cited

U.S. PATENT DOCUMENTS 3,045,240 * 7/1962 Raynor ..... 343/808
4,062,019 * 12/1977 Woodward et al. ..... 343/797
4,446,465 5/1984 Donovan ..... 343/797

FOREIGN PATENT DOCUMENTS 0 936 693 A1 8/1999 (EP) .

* cited by examiner

*Primary Examiner*—Michael C. Wimer

(57) ABSTRACT

A circularly polarized cross dipole antenna according to the present invention includes a cross dipole antenna element formed of two pairs of inverted-V-shaped dipole antenna elements, which are bent like an inverted "V" at a set angle, so as to cross each other on a ground plane, and a feeding mechanism provided to perform a single-point feed through a feeding section common to the inverted-V-shaped dipole antenna elements of the cross dipole antenna element.

1 Claim, 6 Drawing Sheets

C31: 3dB WIDTH OF AXIAL RATIO
C32: 3dB WIDTH OF GAIN
C33: IMPEDANCE (REAL)
C34: IMPEDANCE (IMAGINARY)

C41: θs = 5° (7.87dBi)
C42: θs = 45° (6.82dBi)
C43: θs = 80° (6.12dBi)

CIRCULARLY POLARIZED CROSS DIPOLE ANTENNA

CROSS-REFERENCE TO RELATED APPLICATIONS

This application is based upon and claims the benefit of priority from the prior Japanese Patent Application No. 11-292460, filed Oct. 14, 1999, the entire contents of which are incorporated herein by reference.

BACKGROUND OF THE INVENTION

The present invention relates to a circularly polarized cross dipole antenna which is favorably used as a mobile communication antenna for a GPS wave receiving system, a transmitting/receiving system of a satellite communications cellular phone, and the like.

FIGS. 10A and 10B are illustrations for describing an overview of a prior art circularly polarized cross dipole antenna. FIG. 10A illustrates a dipole antenna, while FIG. 10B does a cross dipole antenna. The dipole antenna shown in FIG. 10A is assembled by forming a single dipole antenna element 101 on a ground plate 100, whereas the cross dipole antenna shown in FIG. 10B is assembled by forming a pair of dipole antennas 101 and 102 on the ground plate 100 so as to cross each other. The cross dipole antenna excites a circularly polarized wave by shifting its phase 90 degrees.

An axial ratio characteristic is important to an antenna for exciting a circularly polarized wave. In the cross dipole antenna illustrated in FIG. 10B, the axial ratio characteristic of each of the dipole antenna elements 101 and 102 crossing each other is a problem. The axial ratio characteristic becomes good when a gain characteristic of E plane (where an electric field is generated) in each of the dipole antenna elements 101 and 102 is equal to that of H plane (where a magnetic field is generated) therein. When these gain characteristics differ from each other, the axial ratio characteristic becomes worse by an amount corresponding to the difference.

FIG. 11 is a chart of the comparison of a gain characteristic of E plane (C1 indicated by the solid line) and that of H plane (C2 indicated by the broken line) in the single dipole antenna element 101 shown in FIG. 10A. It is seen from FIG. 11 that the gain characteristics C1 and C2 are different very widely.

If a cross dipole antenna is assembled by simply crossing two dipole antenna elements having the above characteristics, an axial ratio of them is satisfactory in the vicinity of 0° but it is unsatisfactory at the other angles. It is thus difficult to obtain a circularly polarized cross dipole antenna having a wide-angle axial ratio characteristic even though it is assembled by simply combining two dipole antenna elements having a conventional structure.

BRIEF SUMMARY OF THE INVENTION

An object of the present invention is to provide a circularly polarized cross dipole antenna having an excellent axial ratio characteristic across a wide angle though its structure is simple.

To attain the above object, the circularly polarized cross dipole antenna according to the present invention has the following features in structure. The other features of the present invention will be clarified later in the Description of the Invention.

The circularly polarized cross dipole antenna according to the present invention comprises a cross dipole antenna element formed of two pairs of inverted-V-shaped dipole antenna elements, which are bent like an inverted "V" at a set angle, so as to cross each other on a ground plane; and a feeding mechanism provided to perform a single-point feed through a feeding section common to the inverted-V-shaped dipole antenna elements of the cross dipole antenna element.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

First Embodiment

Figure 1:
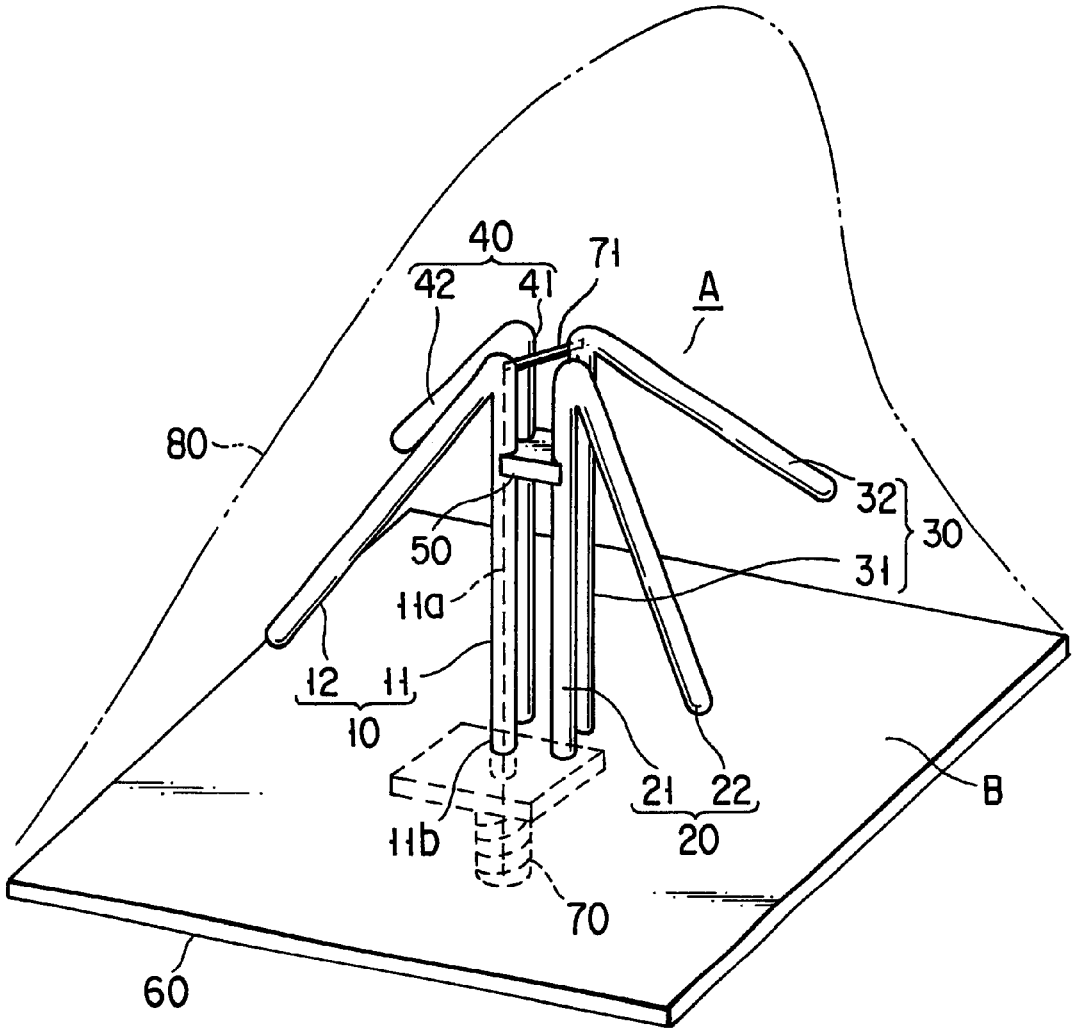
FIG. 1 is a perspective view showing a circularly polarized cross dipole antenna according to a first embodiment of the present invention.
Figure 2:
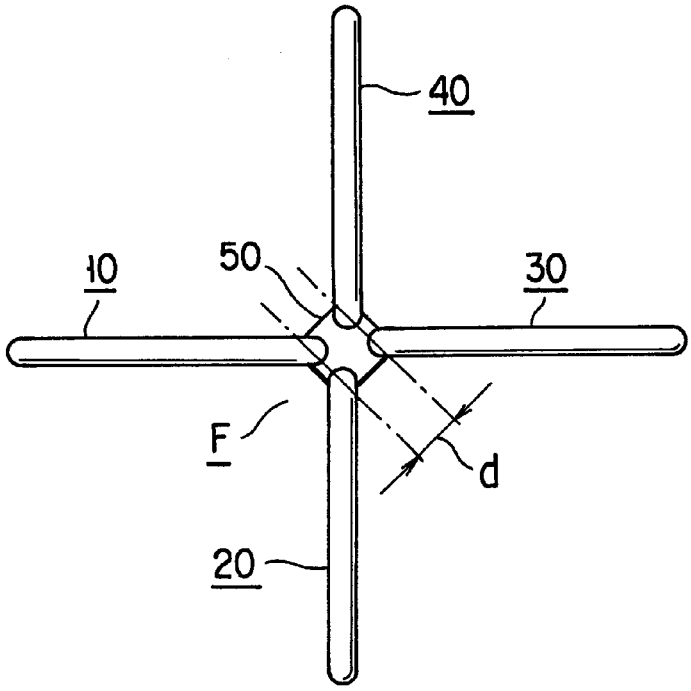
FIG. 2 is a top view of the circularly polarized cross dipole antenna according to the first embodiment of the present invention.
Figure 3:
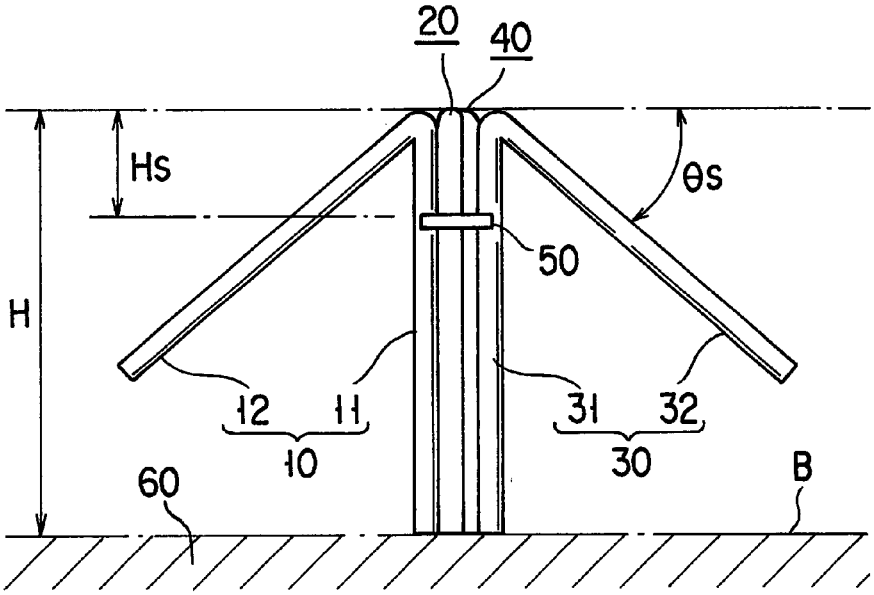
FIG. 3 is a side view of the circularly polarized cross dipole antenna according to the first embodiment of the present invention.

As illustrated in FIGS. 1 to 3, a circularly polarized cross dipole antenna according to the first embodiment includes a cross dipole antenna element A constituted of four inverted- V-shaped dipole antenna elements 10, 20, 30 and 40 which are integrated as one unit. The dipole antenna elements 10, 20, 30 and 40 include their respective pole portions 11, 21, 31 and 41, and the pole portions 11, 21, 31 and 41 have their respective arm portions 12, 22, 32 and 42 at their tops. The "inverted-V-shaped" means that the arm portions 12, 22, 32 and 42 are each inclined from the top toward the ground at a given angle θs.

Focusing attention to one dipole antenna element 10, it includes a pole portion 11 standing vertically on a ground plane B (the surface of ground member 60) and having a height H and an arm portion 12 one end of which is coupled to the top of the pole portion 11 and the other end of which is held in a position where it is closer to the ground plane B than the one end of the arm portion 12. The arm portion 12 is thus inclined at the given angle θs.

The other elements 20, 30 and 40 also include pole portions 21, 31 and 41 and arm portions 22, 32 and 42, respectively.

The pole portions 11, 21, 31 and 41 of the dipole antenna elements 10, 20, 30 and 40 are coupled to one another by means of a short-circuit member 50 at a distance of Hs from their tops. The pole portions 11, 21, 31 and 41 are therefore electrically short-circuited at the coupling portion to achieve a single-point feed structure. In other words, the dipole antenna elements 10, 20, 30 and 40 are so designed as to perform a single-point feed through the short-circuit member 50 which is a common feeding section of a feeding mechanism F.

As illustrated in FIG. 1, one of the pole portions 11, 21, 31 and 41 of the dipole antenna elements 10, 20, 30 and 40, e.g., the pole portion 11 is so constituted that its core wire 11*a* and conductive pipe 11*b* are arranged coaxially with each other. The proximal end of the conductive pipe 11*b* is connected to the ground member 60, while that of the core wire 11*a* insulatively penetrates the ground member 60 and then connects to the central conductor of a coaxial feeder-connecting connector 70 attached to the underside of the ground member 60.

The distal end of the core wire 11*a* is connected to that of the conductive pipe 11*b* at the top of the pole portion 11. The top of the pole portion 11 is short-circuited with that of another pole portion 31, which stands diagonally with respect to the pole portion 11, by means of a conductor 71.

In order to mount the above-described antenna on an object such as an automobile, it is preferable that the ground member 60 be used as a mount plate and the entire antenna be covered with a cover 80 having a streamlined shape or another desired shape.

If, as described above, the dipole antenna elements 10, 20, 30 and 40 are each shaped like an inverted "V", the gain characteristics of E and H planes in each of the antenna elements are approximate to each other across a wide angle. This situation is specifically shown in FIG. 4.

Figure 4:
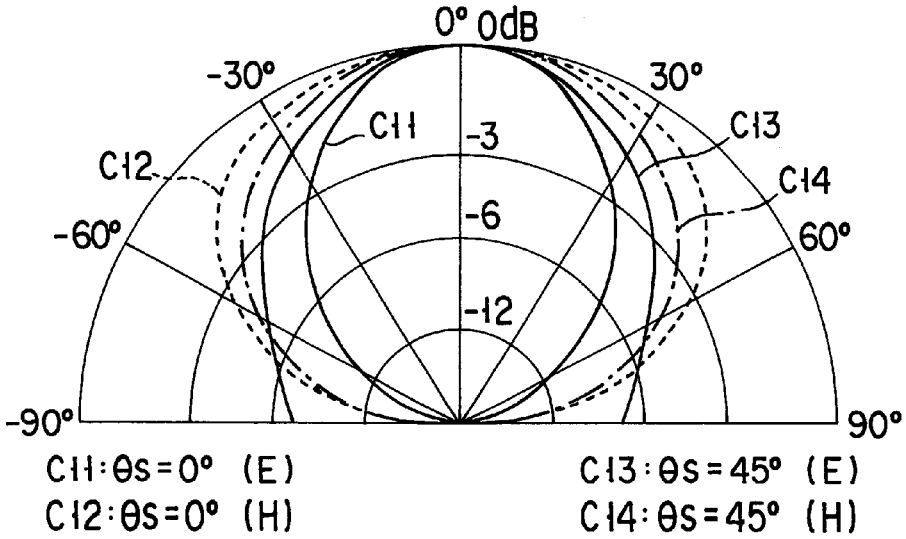
FIG. 4 is a chart for describing a function of an inverted-V-shaped dipole antenna element of the circularly polarized cross dipole antenna according to the first embodiment of the present invention.

In FIG. 4, characteristic curve C11 indicates the gain characteristic of E plane when the inclination angle θs is 0°, character curve C12 indicates the gain characteristic of H plane when the inclination angle θs is 0°, character curve C13 indicates the gain characteristic of E plane when the inclination angle θs is 45°, and character curve C14 indicates the gain characteristic of H plane when the inclination angle θs is 45°.

It is apparent from FIG. 4 that the gain characteristics of E and H planes are different from each other so widely when the angle θs is 0°. In contrast, they are considerably closer to each other when the angle θs is 45°.

If, therefore, the four inverted-V-shaped dipole antenna elements 10, 20, 30 and 40 are combined by properly setting the inclination angle θs, the circularly polarized cross dipole antenna having an axial ratio characteristic can be obtained as shown in FIG. 1.

A condition for acquiring an excellent axial ratio characteristic across a wide angle will now be described. If the gain characteristics of E and H planes of the dipole antenna elements 10, 20, 30 and 40 are set equal to each other, the axial ratio characteristic is satisfied. By varying the height H of each of the pole portions 11, 21, 31 and 41 of the dipole antenna elements 10, 20, 30 and 40, the length L of each of the arm portions 12, 22, 32 and 42, and the inclination angle θs, the length L was obtained by simulation such that a difference between the gain characteristics of E and H planes in the range from 0° to 60° was minimized.

If the real part R and imaginary part X of input impedance Z does not satisfy the following relationship: R=−X, a difference between gains of E and H planes at an inclination angle of 0° does not become zero and thus no polarized waves are obtained. The structure for satisfying the above condition was also obtained by simulation.

Figure 5:
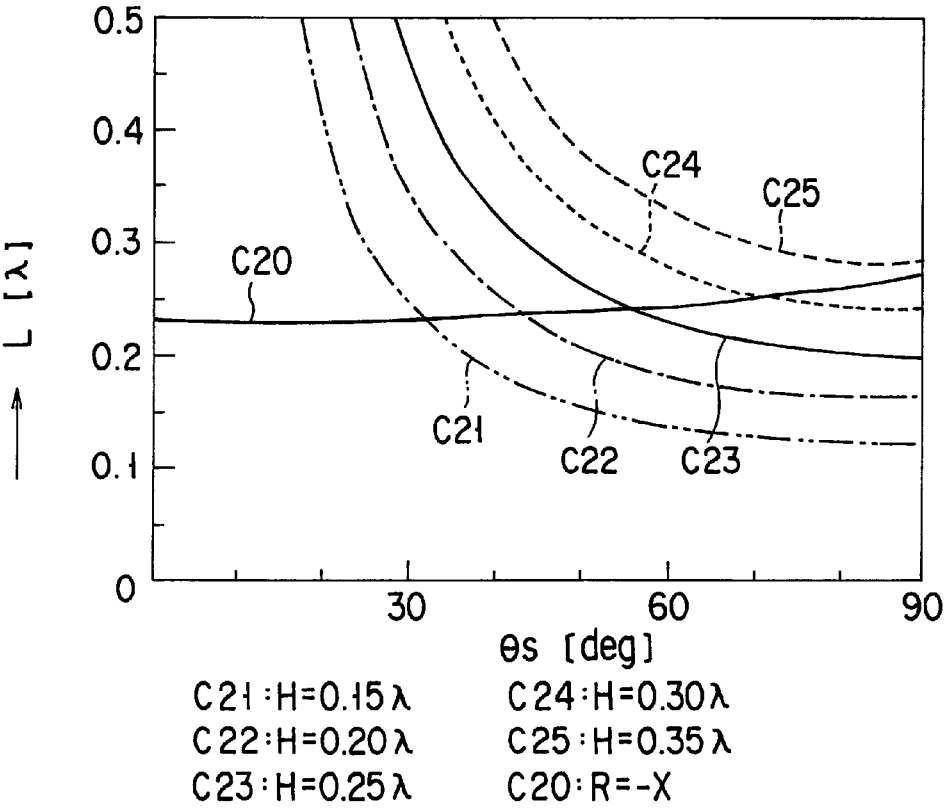
FIG. 5 is a graph showing conditions for acquiring a wide-angle axial ratio characteristic of the circularly polarized cross dipole antenna according to the first embodiment of the present invention.

FIG. 5 is a graph showing results of the above simulation. In FIG. 5, the horizontal axis represents the inclination angle θs and the vertical axis does the length L of each of the arm portions 12, 22, 32 and 42 on a wavelength basis. C21 to C25 indicate a relationship between the inclination angle θs and the length L of each of the arm portions 12, 22, 32 and 42 when the above height H is used as a parameter. Further, C20 indicates a relationship between the inclination angle θs and the length L of each of the arm portions 12, 22, 32 and 42 to satisfy the second condition: R=−X for obtaining a circularly polarized wave.

If both the condition of R=−X in the impedance X and that of the length L of each of the arm portions 12, 22, 32 and 42 corresponding to variations in the height H of the pole portions 11, 12, 31 and 41 are satisfied simultaneously, an excellent axial ratio characteristic can be obtained. In FIG. 5, therefore, intersection points of the curves C21 to C25 and the curve C20 correspond to the conditions for obtaining the excellent axial ratio characteristic.

Next a distance Hs from the top of each of the pole portions 11, 21, 31 and 41 to the short-circuit member 50 will be described. When the cross dipole antenna has a single-point feed structure, the axial ratio characteristics greatly depends upon how the height of the short-circuit member 50 for short-circuiting the pole portions 11, 21, 31 and 41, i.e., the distance Hs is determined. The input impedance Z(X/R) of the dipole antenna, the height H of the pole portions 11, 21, 31 and 41, the height of the short-circuit member 50, i.e., the distance Hs are expressed by the following equation:

$$X/R=\sin\beta(H+Hs)/\sin\beta(H-Hs) \quad (1)$$

where β is a phase constant.

Hereinafter the above equation will be called an Hs design equation (1). By setting the distance Hs based on the equation (1), a good axial ratio characteristic can be secured.

The structure of the cross dipole antenna having good axial ratio characteristic will now be described.

As described above referring to FIG. 5, the height H of each of the pole portions 11, 21, 31 and 41 and the length L of each of the arm portions 12, 22, 32 and 42 corresponding to the height H can be measured by the inclination angle θs. The cross dipole antenna having a single-point feed structure can be optimized from the input impedance Z and the Hs design equation (1).

Figure 6:
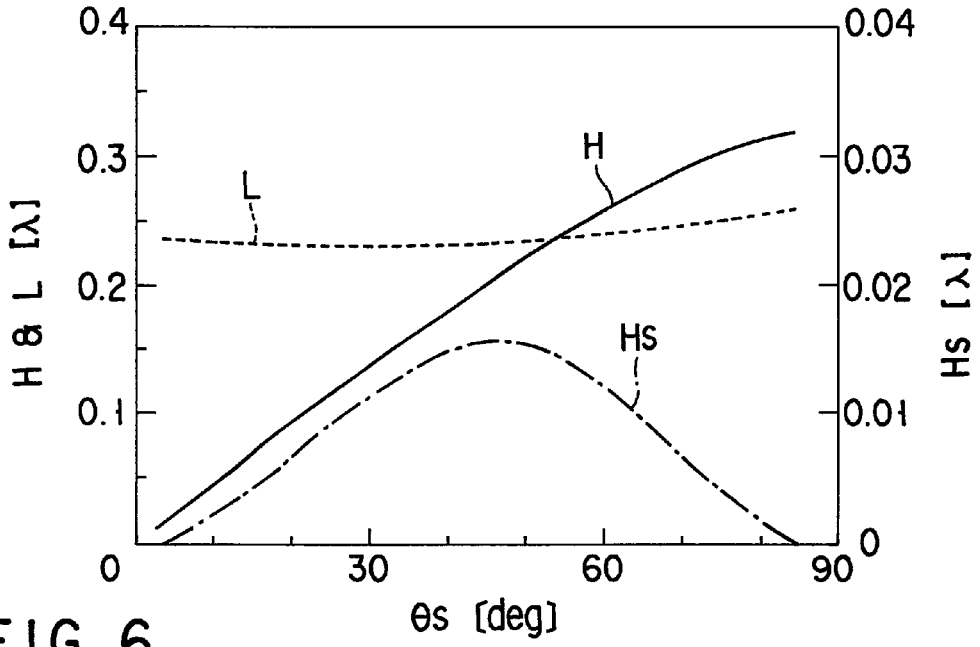
FIG. 6 is a graph showing the optimum-structure data acquired when an inclination angle of the circularly polarized cross dipole antenna according to the first embodiment of the present invention is varied.

FIG. 6 is a graph showing the optimum-structure data of the cross dipole antenna which is acquired when the inclination angle θs is varied, that is, the optimum interrelationship among the height H of each of the pole portions 11, 21, 31 and 41, the length L of each of the arm portions 12, 22, 32 and 42, and the distance Hs from the top of each of the pole portions to the short-circuit member 50 with respect to the inclination angle θs.

Figure 7:
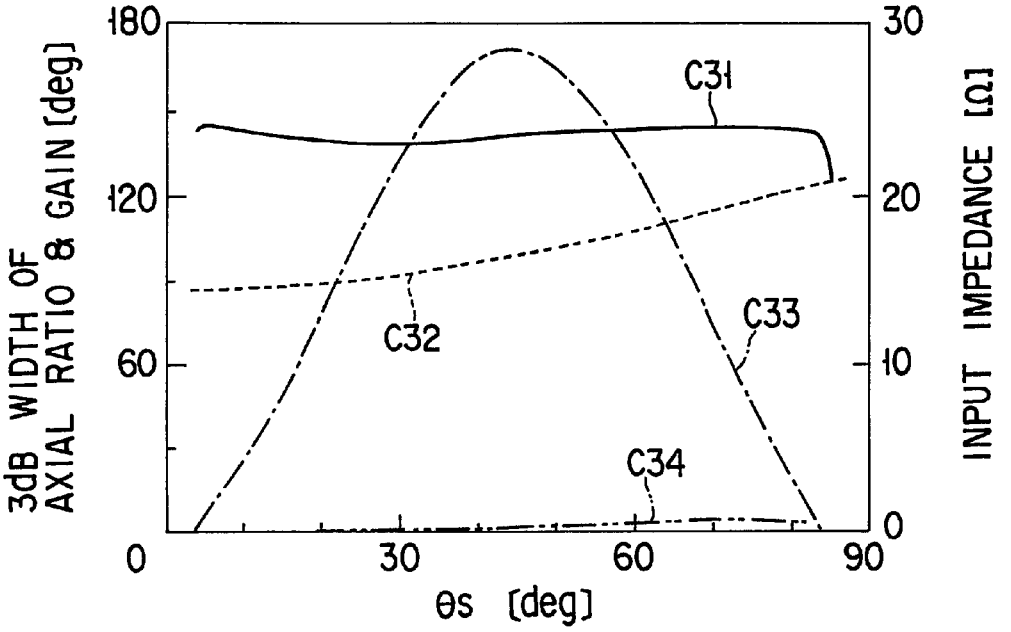
FIG. 7 is a graph showing a relationship between the 3 dB width (half-value angle) of axial ratio and gain and the input impedance with respect to the inclination angle when the circularly polarized cross dipole antenna according to the first embodiment of the present invention has the optimum structure.

FIG. 7 is a graph showing a relationship between the 3 dB width (half-value angle) of axial ratio and gain and the input impedance with respect to the inclination angle θs when the cross dipole antenna has the optimum structure.

Figure 8:
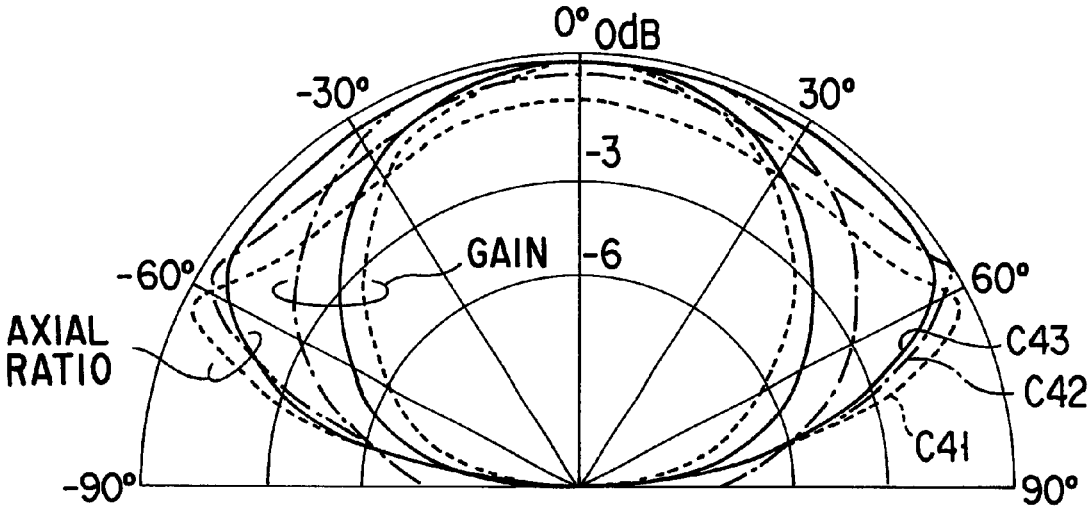
FIG. 8 is a chart showing a typical example of the axial ratio characteristic and the gain characteristic of the circularly polarized cross dipole antenna according to the first embodiment of the present invention.

FIG. 8 is a chart showing the gain and axial ratio characteristics when the inclination angle θs is varied from 0° to 45° and from 45° to 80°. Unless a distance d between opposing pole portions is sufficiently small, an error of the Hs design equation (1) is increased. For this reason, d is set equal to $10^{-4}$ λ. When the inclination angle θs of each of the arm portions 12, 22, 32 and 42 is set to approximately 5° as shown in FIG. 8, the 3 dB width of the axial ratio is considerably increased.

It is thus seen from FIG. 8 that the distance Hs from the top of each of the pole portions 11, 21, 31 and 41 to the short-circuit member 50 is uniquely determined for the inclination angle θs and, if the inclination angle θs is determined without being set to an extreme value, the length L of each of the arm portions and the distance Hs produce an excellent axial ratio characteristic.

The circularly polarized cross dipole antenna according to the first embodiment of the present invention has a single-point feed structure in which the dipole antenna elements 10, 20, 30 and 40 are bent and shaped like an inverted "V" and the pole portions 11, 21, 31 and 41 are employed. A circularly polarized dipole antenna having a simple feed structure and a wide-angle axial ratio characteristic can thus be attained. The structure of the antenna can be achieved easily and accurately by setting the height H of each of the pole portions 11, 21, 31 and 41, the length L of each of the arm portions 12, 22, 32 and 42, the inclination angle θs of each of the arm portions 12, 22, 32 and 42, the height Hs of the short-circuit member 50, and impendence Z, so as to approximate the gain characteristics of E and H planes of each of the dipole antenna elements 10, 20, 30 and 40 to each other. Consequently, a circularly polarized cross dipole antenna for fulfilling a desired function can stably be provided.

Second Embodiment

Figure 9:
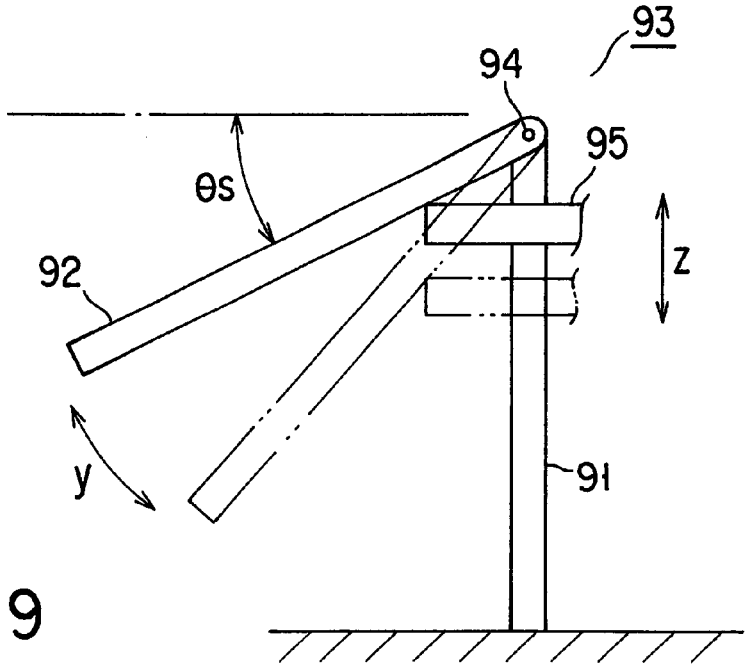
FIG. 9 is a partly cutaway side view of the main part of a circularly polarized cross dipole antenna according to a second embodiment of the present invention.
Figure 10A:
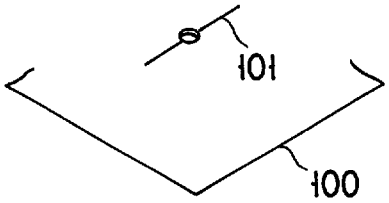
(PRIOR ART) FIG. 10A
FIGS. 10A and 10B are illustrations for describing an overview of a prior art circularly cross dipole antenna.
Figure 10B:
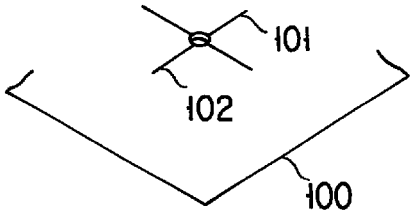
(PRIOR ART) FIG. 10B
Figure 11:
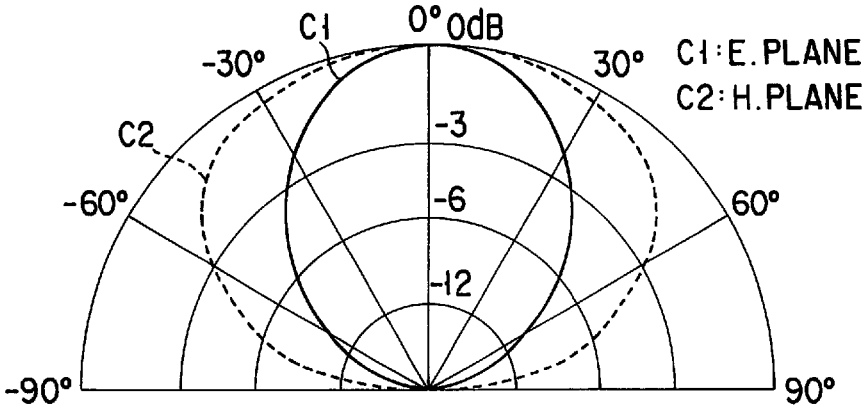
FIG. 11 (PRIOR ART)
FIG. 11 is a chart of the comparison of a gain characteristic of E plane and that of H plane in the prior art circularly polarized cross dipole antenna.

FIG. 9 is a side view showing a major part of a circularly polarized cross dipole antenna according to a second embodiment of the present invention. It is in an angle adjustment mechanism 93 for variably setting the inclination angle θs of an arm portion 92 that the second embodiment differs from the first embodiment. More specifically, one end of the arm portion 92 is coupled to the top of a pole portion 91 such that it can be moved up and down, as indicated by double-headed arrow y in FIG. 9, by means of a shaft mechanism 94. In order to stabilize the adjusted inclination angle θs, the arm portion 92 can be supported by an insulating support member 95 which is slidably fitted on the pole portion 91 as indicated by double-headed arrow z. Thus, the inclination angle of the arm portion 92 can be set variably.

Features of the Embodiments

[1] A circularly polarized cross dipole antenna according to the embodiments, wherein paired dipole antenna elements (10, 30; 20, 40) are each bent like an inverted "V" to control a gain characteristic of the antenna and an axial ratio characteristic thereof.

[2] A circularly polarized cross dipole antenna according to the embodiments, which allows a circularly polarized wave to be excited by arranging paired dipole antenna elements (10, 30; 20, 40) so as to cross each other, wherein the paired dipole antenna elements (10, 30; 20, 40) are inverted-V-shaped antenna elements each of which is bent like an inverted "V" at a set angle.

[3] The circularly polarized cross dipole antenna described in above item [2], wherein the inverted-V-shaped antenna elements have pole portions (11, 21, 31, 41) standing vertically on a ground plane (B) and arm portions (12, 22, 32, 42) inclined at a set inclination angle (θs) such that one end of each of the arm portions is coupled to a top of each of the pole portions and another end thereof is held in a position closer to the ground plane (B) than the one end of each of the arm portions.

[4] The circularly polarized cross dipole antenna described in above item [3], wherein the pole portions (11, 21, 31, 41) of the inverted-V-shaped antenna elements are coupled to one another by a short-circuit member (50) to have a single-point feed structure.

[5] The circularly polarized cross dipole antenna described in-above item [3], comprising an angle adjustment mechanism (93) for variably setting the inclination angle (θs) of an arm portion (92).

(Modifications)

The circularly polarized cross dipole antenna described in the above embodiments includes the following modifications:

i) A dipole antenna element having a gently-curved or acute-angled L-shaped arm portion; and ii) A dipole antenna element formed by adhering a thin-film conductor onto a substrate.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A circularly polarized cross dipole antenna comprising:

a cross dipole antenna element formed of two pairs of inverted-V-shaped dipole antenna elements, which are bent like an inverted "V" at a set angle and arranged so as to cross each other on a ground plane; and a feeding mechanism provided to perform a single-point feed through a feeding section common to the inverted-V-shaped dipole antenna elements of the cross dipole antenna element, wherein each of the inverted-V-shaped dipole antenna elements comprises:

a pole portion standing vertically on the ground plane;

an arm portion one end of which is rotatably coupled to a top of the pole portion by a pivot mechanism and another end of which is provided so as to move close to or away from the ground plane in a region closer to the ground plane than the one end of the arm portion; and a plate-shaped insulating support member, slidably fitted on the pole portion and fixed at a predetermined level of the pole portion, for supporting the arm portion at a predetermined angle by supporting the arm portion from below on a periphery of the insulating member.

* * * * *